US007901257B2

(12) United States Patent
Okamura et al.

(10) Patent No.: US 7,901,257 B2
(45) Date of Patent: Mar. 8, 2011

(54) TERMINAL FITTING

(75) Inventors: Kenji Okamura, Yokkaichi (JP); Motoki Kubota, Yokkaichi (JP); Kazuhide Muneyasu, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/483,480

(22) Filed: Jun. 12, 2009

(65) Prior Publication Data

US 2010/0035485 A1 Feb. 11, 2010

(30) Foreign Application Priority Data

Aug. 6, 2008 (JP) ..... 2008-202803
Aug. 19, 2008 (JP) ..... 2008-211198
Sep. 16, 2008 (JP) ..... 2008-236738

(51) Int. Cl.
*H01R 4/10* (2006.01)

(52) U.S. Cl. ..... 439/877

(58) Field of Classification Search ..... 439/877, 439/852, 851, 862, 816, 424, 421, 422, 442
See application file for complete search history.

(56) References Cited

U.S. PATENT DOCUMENTS 3,892,459 A * 7/1975 Dittmann et al. ..... 439/442
3,953,103 A 4/1976 Mathis
3,963,857 A * 6/1976 Reynolds et al. ..... 174/84 C
4,082,402 A * 4/1978 Kinkaid et al. ..... 439/422
4,142,771 A 3/1979 Barnes
5,344,348 A 9/1994 Willis
6,565,376 B2 * 5/2003 Aoki ..... 439/422
6,736,664 B2 * 5/2004 Ueda et al. ..... 439/423
7,402,089 B1 7/2008 Myer et al.
2007/0111613 A1 * 5/2007 Kumakura ..... 439/851
2007/0202726 A1 8/2007 Lee et al.

FOREIGN PATENT DOCUMENTS

JP 11-219735 8/1999
JP 2006-228759 8/2006
JP 2007-012341 1/2007

* cited by examiner

*Primary Examiner* — T C Patel
*Assistant Examiner* — Phuongchi T Nguyen
(74) *Attorney, Agent, or Firm* — Gerald E. Hespos; Michael J. Porco

(57) ABSTRACT

A terminal fitting (10, 130, 510) has a connecting portion (11, 131, 511) to be connected with a mating connecting portion, and a crimping portion (12, 140) continuous with the rear end of the connecting portion (11, 131, 511) and including a bottom plate (21, 148, 515) and crimping pieces (22, 147, 516) standing up from the bottom plate (21, 148, 515). The crimping portion (12, 140) is crimped into connection with a wire (30, 120, 590) while surrounding an end portion of the wire (30, 120, 590) by the bottom plate (21, 148, 515) and the crimping pieces (22, 147, 516). The bottom plate (21, 148, 515) is formed with a reinforcing rib (24, 150, 250, 350, 450, 525) extending in forward and backward directions.

14 Claims, 14 Drawing Sheets

TERMINAL FITTING

BACKGROUND OF THE INVENTION

1. Field of the Invention

The invention relates to a terminal fitting.

2. Description of the Related Art

Japanese Unexamined Patent Publication Nos. 2006-228759, 2007-12341 and H11-219735 disclose conventional terminal fittings. A connecting portion is formed at the front end of each of these terminal fittings for connection with a mating connecting portion of a mating terminal. The terminal fitting also includes a bottom plate that is flat in forward and backward directions. Front and rear pairs of crimping pieces stand up from the opposite left and right edges of the bottom plate to form a wire barrel and an insulation barrel rearward of the wire barrel. The front crimping pieces are pressed from above and crimped to surround and engage a core exposed by removing an insulation coating at an end of a wire. The rear crimping pieces are pressed from above and crimped to surround and engage an insulated part of the wire in the insulation barrel.

A force that presses the crimping pieces of each of the above-identified terminal fittings from above is likely to act on the bottom plate while crimping the wire barrel and the insulation barrel, thereby warping the terminal fitting upwardly. More particularly, the wire barrel must be fastened strongly to the core. Thus, the crimping pieces are pressed from above with a large force that acts on the bottom plate and warps the terminal fitting upwardly.

If the wire barrel presses the core, the bottom plate is squashed and elongates in forward and backward directions, thereby elongating the entire terminal fitting. Elongation of the terminal fitting may cause problems, such as protrusion of the terminal fitting from a cavity if the terminal fitting is accommodated in the cavity of a connector or the like.

The wire may have a core formed by twisting strands made of aluminum or aluminum alloy. In this case, a force for crimping the wire barrel needs to be increased to destroy an insulating oxide coating formed on the outer surface of the core. Therefore, the terminal fitting is likely to warp.

The invention was developed in view of the above situation and an object thereof is to prevent a warping and/or elongation of a terminal fitting.

SUMMARY OF THE INVENTION

The invention relates to a terminal fitting with a connecting portion to be connected with a mating connecting portion. A crimping portion is substantially continuous with the rear end of the connecting portion. The crimping portion has a bottom plate and crimping pieces that project from the bottom plate. The crimping portion is to be crimped into connection with a wire so that an end portion of the wire is at least partly surrounded by the bottom plate and the crimping pieces. The bottom plate is formed with at least one reinforcing rib extending in substantially forward and backward directions. The reinforcing rib increases rigidity of the bottom plate and prevents warping deformation and elongation deformation of the terminal fitting even if a pressing force on the crimping pieces acts on the bottom plate while crimping the crimping portion.

The reinforcing rib preferably projects toward a wire side, and preferably is formed by being hammered or embossed. More particularly, the reinforcing rib preferably is formed by being hammered toward a wire side. Thus, there is no likelihood of the enlargement of the terminal fitting.

The crimping portion preferably includes at least one wire barrel to be crimped into connection with a core exposed by removing an insulation coating at an end portion of the wire. The reinforcing rib is formed at least over the entire region of the wire barrel in forward and backward directions.

The wire barrel must be fastened strongly to the core. Thus, the crimping pieces are pressed from above with a large force. The large force acts on the bottom plate of the wire barrel from above and can warp the terminal fitting upwardly. However, the reinforcing rib is formed at least over the entire region of the wire barrel in forward and backward directions. Thus, warping deformation and/or elongation of the terminal fitting is prevented reliably even if a large force acts on the bottom plate portion of the wire barrel from above.

The crimping portion is crimped so that the leading ends of the crimping pieces substantially face the bottom plate, and the reinforcing rib is formed at a position to substantially face the leading ends of the crimping pieces when the crimping portion is crimped.

A force that presses the crimping pieces upon crimping the crimping portion acts most strongly at a position of the bottom plate facing the leading ends of the crimping pieces and may warp the terminal fitting. However, the reinforcing rib is at a width position of the bottom plate substantially aligned with the leading ends of the crimping pieces upon crimping the crimping portion. Thus, warping deformation of the terminal fitting is prevented more reliably.

The reinforcing rib preferably is formed by applying a bending process to a plate material. Thus, the reinforcing rib strengthens the bottom plate and it is difficult to squash the bottom plate. Thus, the bottom plate is lees likely to be elongated by squashing the bottom plate portion and elongation of the entire terminal fitting is suppressed.

The reinforcing rib preferably is formed by folding the plate material. Thus, the plate material need not be cut to form the reinforcing rib. Further, the thickness of the reinforcing rib is double the thickness of the plate material when the two plate parts are put together.

The reinforcing rib may project toward a wire side. Thus, the surface area of the bottom plate that contacts the wire is increased and an electrically connected state of the wire and the terminal fitting is improved.

The bending process preferably is applied to the reinforcing rib so that the leading end of a U-shaped folded part is bent laterally and substantially faces in a width direction.

The folded part of a plate that merely is folded may be opened when an excessive compression force acts during a crimping operation. However, the leading end of the U-shaped folded part is bent substantially in the width direction in this embodiment. Thus, the folded part is less susceptible to a force in a direction to open the folded part, and the folded part is less likely to open.

At least one embossment preferably is formed in the outer surface of the reinforcing rib by press working. Additionally, a large pressure is exerted in the outer surface of the reinforcing rib during the crimping operation. Thus, the wire is abraded by the embossment with a large pressure and an oxide film formed on the outer surface of the wire is broken.

The reinforcing rib preferably extends continuously in substantially forward and backward directions from the neck to the insulation barrel. Thus, the rigidity of the bottom plate is increased. Further, the neck, which tends to be narrower than the other parts, also is reinforced.

The projecting end surface of the reinforcing rib functions as a supporting surface for the wire, and hence the wire may wobble if the reinforcing rib is narrow. Accordingly, the reinforcing rib is wider in the insulation barrel than in the wire barrel to prevent the wire from wobbling.

Angular edges are formed at corners of the projecting end of the reinforcing rib at least along the wire barrel, and/or rounded R-portions are formed at positions of the corners of the projecting end of the reinforcing rib at least partly along the insulation barrel. Thus, any insulating coating formed on a core of the wire is removed mechanically by the edges. Further, the rounded R-portions formed at the corners of the projecting end of the reinforcing rib corresponding to the insulation barrel will not damage the outer circumferential surface of the wire when supporting the wire.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
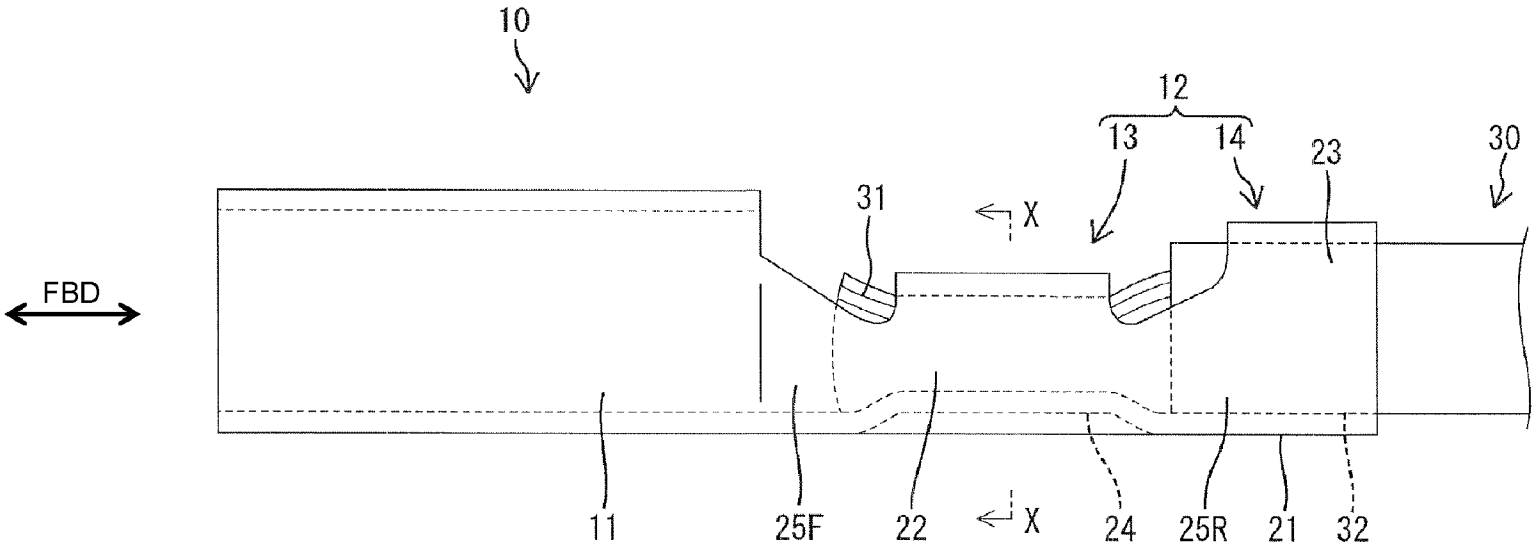
FIG. 1 is a side view of a terminal fitting according to a first embodiment.
Figure 2:
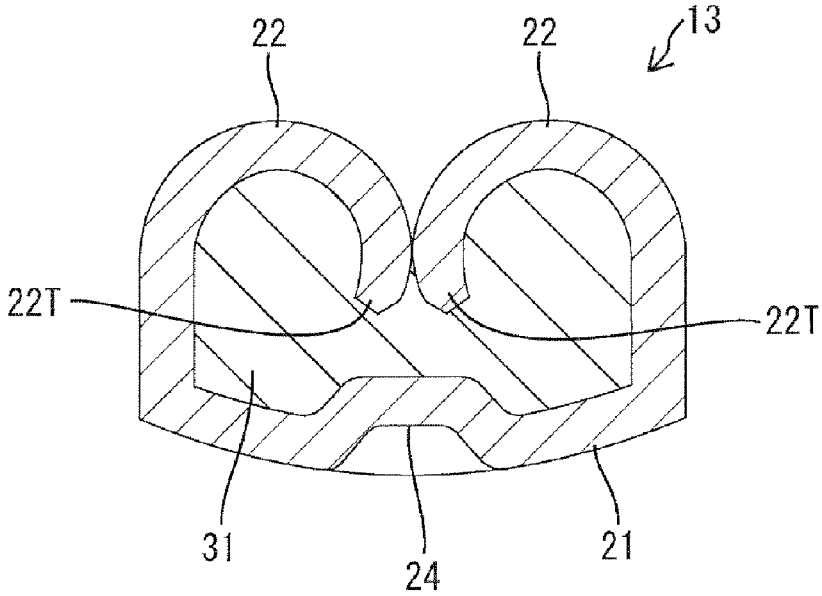
FIG. 2 is a section along X-X of FIG. 1.
Figure 3:
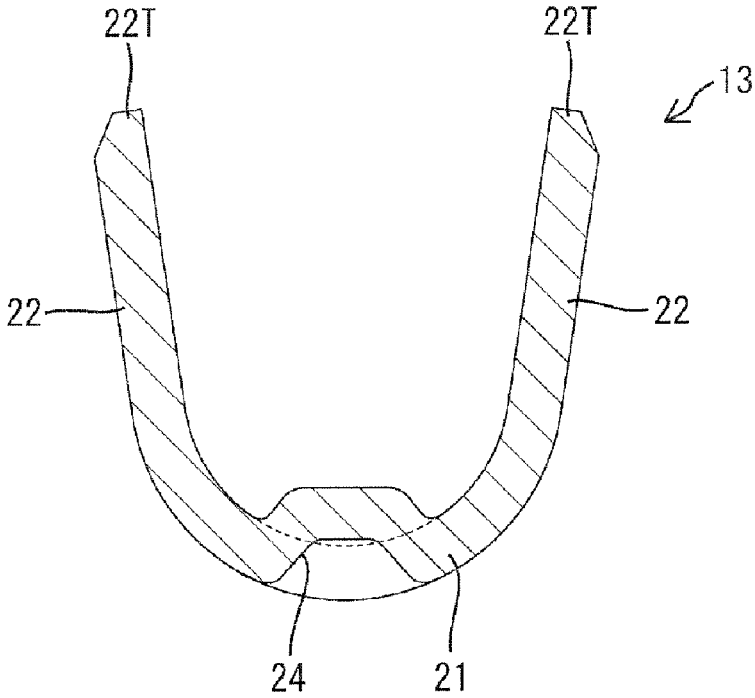
FIG. 3 is a section showing the shape of a wire barrel portion before being crimped.

A female terminal fitting in accordance with a first embodiment of the invention is identified by the numeral 10 in FIGS. 1 to 3. The terminal fitting 10 is configured to be crimped, bent or folded into connection with an end portion of the wire 30 of a wiring harness. The terminal fitting 10 is formed by applying a bending process, a folding process, an embossing process or the like to a conductive (preferably metal) plate material stamped, punched out or cut into a specified shape. A polygonal tubular connecting portion 11 is formed at the front end of the terminal fitting 10 and is configured to receive a long narrow male tab of a mating male terminal.

A crimping portion 12 is formed near a rear end of the terminal fitting 10 for crimped, bent or folded connection with the wire 30. The crimping portion 12 is comprised of a wire barrel 13 and an insulation barrel 14 located behind the wire barrel 13. The wire barrel 13 is continuous with the connecting portion 11 and has a base plate 21 and two crimping pieces 22 project from the opposite left and right edges of the bottom plate 21. The bottom plate 21 and the crimping pieces 22 are laterally symmetrical. The insulation barrel 14 is made up of the bottom plate 21 located behind the wire barrel 13 and two crimping pieces 23 projecting from the opposite left and right edges of the bottom plate 21. The bottom plate 21 and the crimping pieces 23 also are laterally symmetrical. First couplings 25F couple the front ends of the crimping pieces 22 of the wire barrel 13 close to the bottom plate 21 to the rear ends of side walls of the connecting portion 11. Second couplings 25R couple bottom parts of the rear ends of the crimping pieces 22 of the wire barrel 13 to bottom parts of the front ends of the crimping pieces 23 of the insulation barrel 14.

The bottom plate 21 of the terminal fitting 10 is hammered, embossed or stamped to project in toward the wire 30 to form a reinforcing rib 24 that extends continuously and straight in forward and backward directions FBD. The reinforcing rib 24 extends over substantially the entire region of the wire barrel 13 and may extend beyond the wire barrel 13 in forward and backward directions FBD. The reinforcing rib 24 is formed to be substantially laterally symmetrical by locally hammering, embossing or stamping only a central part of the bottom plate 21 with respect to a width direction. A lateral cross-sectional shape of the reinforcing rib 24 is substantially constant over the entire length or is substantially trapezoidal. As shown in FIGS. 2 and 3, the reinforcing rib 24 raises the upper surface of the bottom plate 21 up toward the wire and toward the crimping pieces 22 and the lower surface thereof is indented before the wire barrel 13 is crimped into connection with a core 31.

The core 31 of the wire 30 is exposed e.g. by removing an insulation coating at an end portion of the wire 30. The wire 30 then is placed on the bottom plate 21 of the terminal fitting 10 so that the core 31 is in the wire barrel portion 13 and so that an insulated part 32 of the end portion of the wire 30 is in the insulation barrel 14. In this state, the crimping pieces 22 of the wire barrel 13 and the crimping pieces 23 of the insulation barrel 14 are pressed from above. As shown in FIG. 2, the bottom plate 21 and the crimping pieces 22 in the wire barrel 13 substantially surrounds the core 31 and leading end edges 22T of the crimping pieces 22 are deformed to face toward the bottom plate portion 21 for fastening the core 31. The reinforcing rib 24 formed at the bottom plate 21 of the terminal fitting 10 is formed at a position to face the leading end edges 22T of the crimping pieces 22 in the width direction of the bottom plate 21. The bottom plate 21 and the crimping pieces 23 in the insulation barrel 14, are deformed to surround the insulated part 32 of the end portion of the wire 30 for crimped, bent or folded connection with the insulated part 32 of the end portion of the wire 30.

The reinforcing rib 24 that extends in forward and backward directions FBD along the bottom plate 21 in the above-described wiring harness increases the rigidity of the bottom plate 21. Thus, a force that acts on the bottom plate 21 from above while crimping the wire barrel 13 and the insulation barrel 14 will not warp the terminal fitting 10 upwardly and will not elongate the terminal fitting 10.

The reinforcing rib 24 is formed in a width position of the bottom plate 21 to oppose the leading end edges 22T of the crimping pieces 22 where a force acts most strongly on the bottom plate 21 when the crimping pieces 22 are pressed from above. Therefore, upward warping deformation of the terminal fitting 10 is prevented even more reliably.

In the first embodiment, for example, the following embodiments are also included in the technical scope of the present invention.

The above-described reinforcing rib is formed at least over the entire region of the wire barrel in forward and backward directions FBD. However, the reinforcing rib may be formed: only in a partial region of the wire barrel in forward and backward directions FBD; or from a part of the bottom plate before the wire barrel to a portion of the bottom plate behind the wire barrel; or from a part of the bottom plate before the wire barrel to an intermediate part or the rear end of the wire barrel in forward and backward directions FBD; or from the front end or an intermediate part of the wire barrel in forward and backward directions FBD to the part of the bottom plate behind the wire barrel; or along the entire region of the bottom plate behind the connecting portion.

The above-described reinforcing rib is formed at a width position of the bottom plate to substantially face the leading ends of the crimping pieces when the crimping portion is crimped. However, the formation area of the reinforcing rib may be displaced to the left or right with respect to the widthwise center of the bottom plate. Further, the reinforcing rib may be at a position so as not to face the leading end edges of the crimping pieces when the crimping portion is crimped. Furthermore, a plurality of reinforcing ribs may be formed in the width direction of the bottom plate.

The invention also is applicable to a male terminal fitting with a connecting portion in the form of a long narrow male tab.

Figure 4:
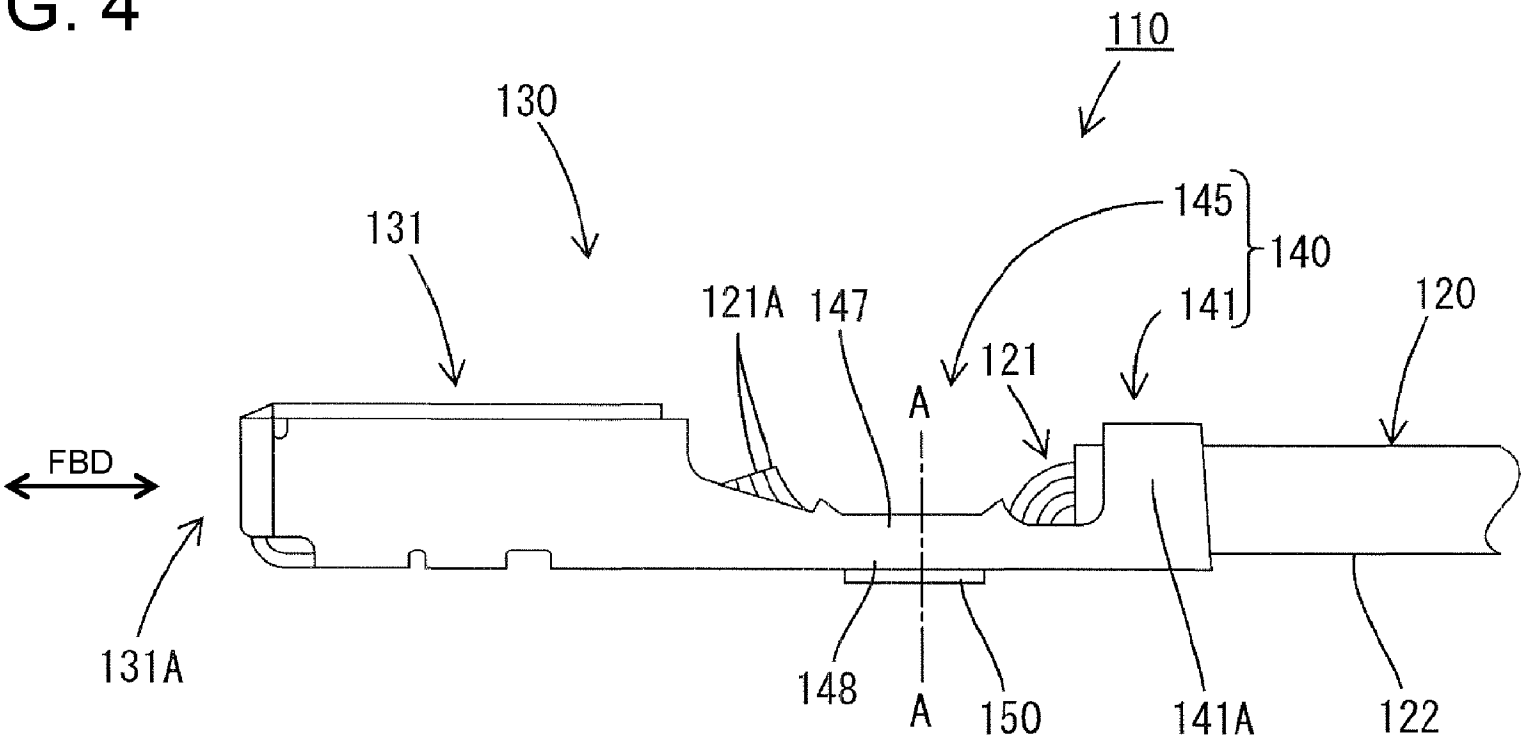
FIG. 4 is a side view of a terminal fitting according to a second embodiment.

A terminal-mounted wire 110 according to a second embodiment is illustrated in FIGS. 4 to 8. The terminal-mounted wire 110 is formed by crimping, bending or folding a female terminal fitting 130 into connection with an end portion of an insulated wire 120 and may be arranged between devices (not shown) such as a battery, an inverter or a motor constituting a driving power source in an electrical car or a hybrid car. In the following description, left and right sides of FIG. 4 are referred to respectively as the front and rear.

The insulated wire 120 has a core 121 formed by spirally twisting a plurality of metal strands 121A made e.g. of aluminum, aluminum alloy or other metal. The core 121 is covered by an insulation coating 122 made e.g. of resin, and the insulation coating 122 is stripped off to expose the core 121 at an end portion of the insulated wire 120.

The terminal fitting 130 is of the open barrel type and is made of a material (e.g. copper or copper alloy) that is stronger than the material used for the core 121 (e.g. aluminum). The terminal fitting 130 includes a box-shaped or tubular connecting portion 131 and a crimping portion 140 that is unitary with the connecting portion 131. The crimping portion 131 is to be connected with the insulated wire 120.

The connecting portion 131 is aligned substantially longitudinally with the crimping portion 140 along a forward and backward direction FBD (lateral direction of FIG. 4) of the wire 120 and is to be connected electrically with a connecting portion of a mating male terminal by insertion of an unillustrated male terminal into an insertion hole 131A.

The crimping portion 140 has an insulation barrel 141 for holding the insulated wire 120 and a wire barrel 145 to be connected with the core 121. The insulation barrel 141 has two crimping pieces 141A that project from left and right edges of a bottom plate 148 that is continuous with the wire barrel 145. The insulated wire 120 is held so as not to be displaced by crimping, bending or folding the crimping pieces 141A toward the insulated wire 120.

Figure 5:
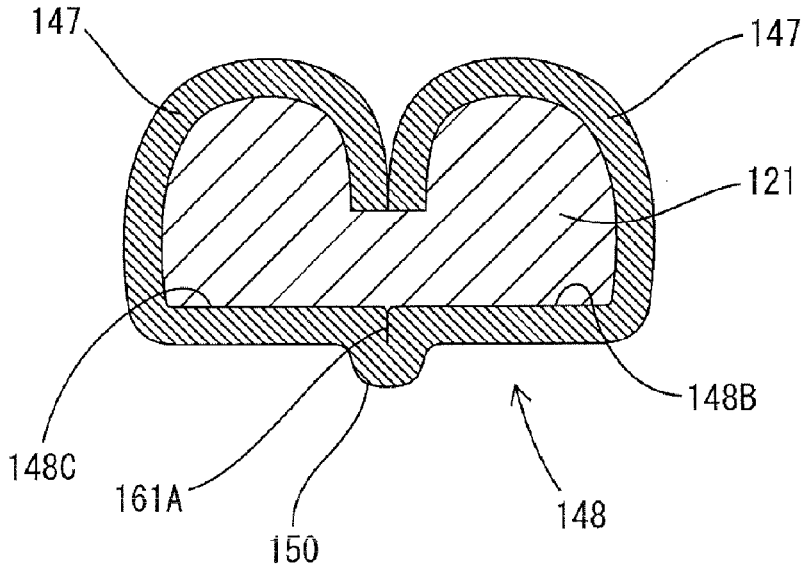
FIG. 5 is a section along A-A of FIG. 4.

As shown in FIG. 5, the wire barrel 145 is comprised of the substantially flat bottom plate 148 and two crimping pieces 147 that extend up from the opposite sides of the bottom plate 148. The crimping pieces 147 extend in a width direction from the opposite sides of the bottom plate 148. The bottom plate 148 has a substantially flat rectangular shape. However, a reinforcing rib 150 projects down and out on the lower or outer surface of the bottom plate 148 on a side substantially opposite to the side to which the crimping pieces 147 project.

The reinforcing rib 150 projects from a substantially widthwise center of the lower surface of the bottom plate 148 and extends in forward and backward directions FBD, i.e. in the same direction as the longitudinal direction of the wire 120 (directions forward and backward of the plane of FIG. 5). Additionally, the reinforcing rib 150 is formed in a part of the bottom plate 148 extending substantially from the front ends to the rear ends of the crimping pieces 147 (see FIG. 4).

The reinforcing rib 150 is formed by folding or bending a flat surface 148B of the bottom plate 148 to define a U-shaped fold that projects down and out substantially in the widthwise center of the bottom plate 148. The bottom plate 148 then is bent to extend laterally to define a substantially flat surface 148C of the bottom plate 148.

Figure 6:
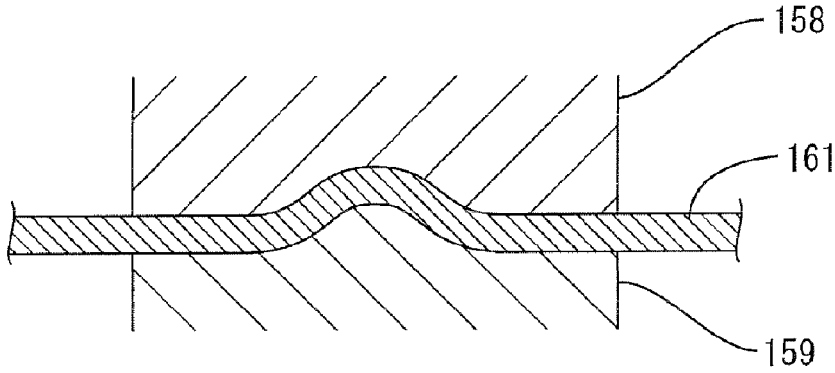
FIG. 6 is a diagram showing a first bending process.
Figure 7:
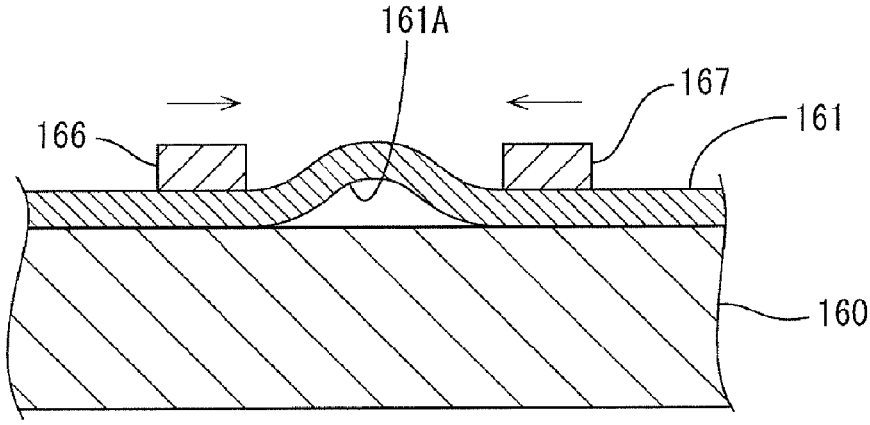
FIG. 7 is a diagram showing a second bending process.

This reinforcing rib 150 is formed by punching, pressing or bending a conductive metal plate. More particularly, the metal plate with a specified thickness is punched out or cut to form a substantially flat terminal fitting plate (not shown). The terminal fitting plate then is pressed from above and below by molds 158, 159 in a press machine to form a terminal plate 161 with a widthwise central part that projects slightly up, as shown in FIG. 6. The terminal plate 161 then is placed on a supporting table 160, as shown in FIG. 7. Supports 166, 167 then press the opposite widthwise sides of the terminal plate 161 against the supporting table 160. The supports 166, 167 then are urged toward one another and toward the widthwise central part (directions of arrows in FIG. 7). The supports 166, 167 are rectangular parallelepipeds that have lengths in the longitudinal direction of the wire 120 that substantially equal the length of the reinforcing rib 150.

The terminal plate 161 then is turned upside down (see FIG. 5). The widthwise central part is urged down to become convex at the lower surface of the bottom plate 148 and a depressed part 161A is squeezed closed. Thus, the upper surface 148B, 148C of the bottom plate 148 becomes a substantially flat surface.

Figure 8:
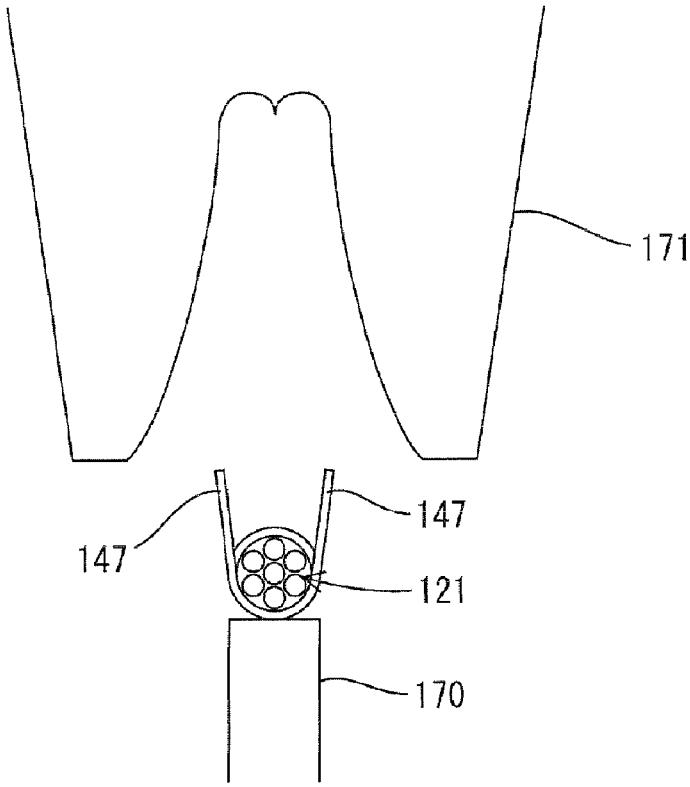
FIG. 8 is a diagram showing a crimper and an anvil at the time of a crimping operation.
Figure 9:
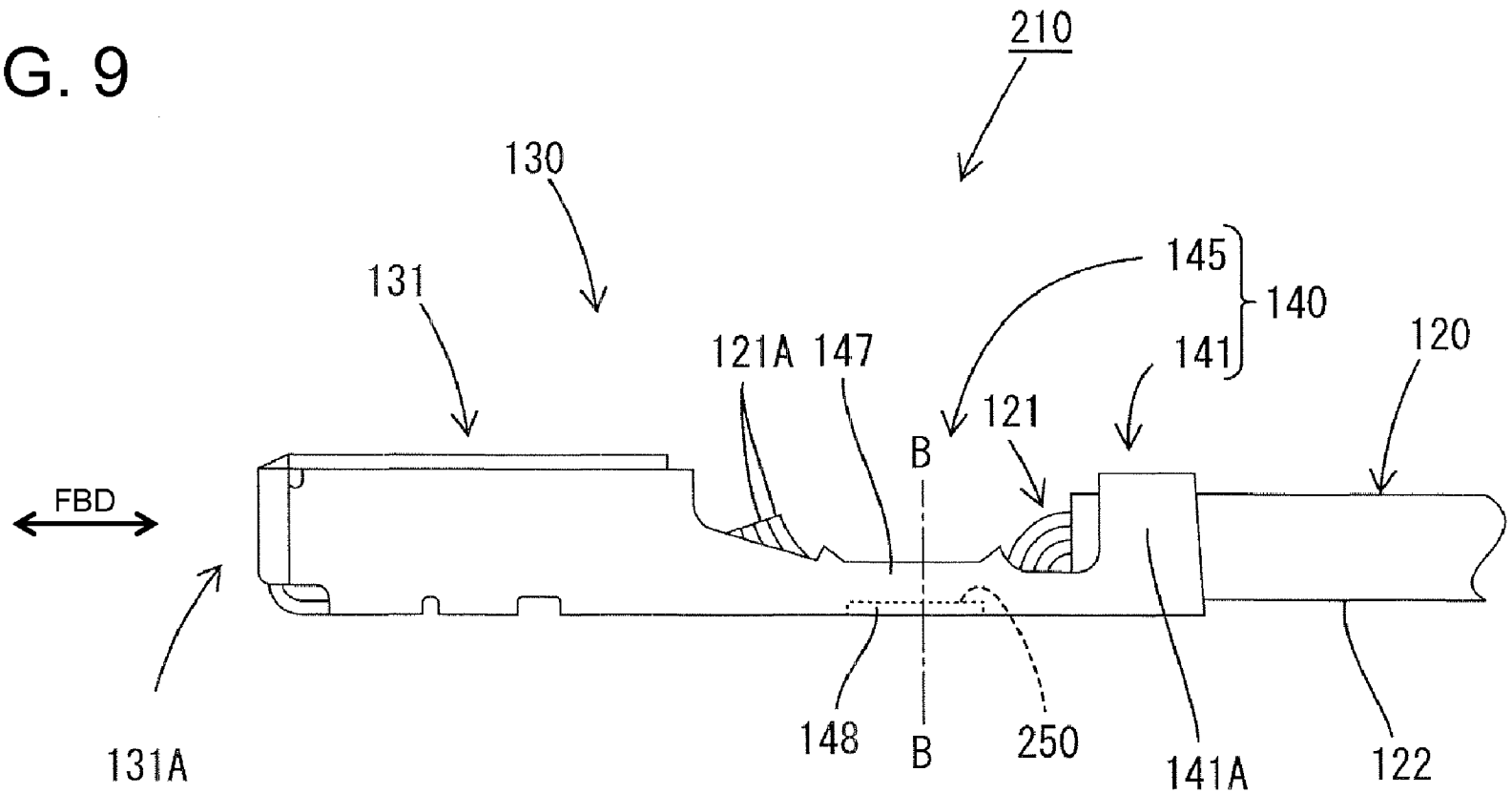
FIG. 9 is a side view of a terminal fitting according to a third embodiment.

The terminal-mounted wire 110 is produced by placing the terminal fitting 130 on an anvil 170 and placing the exposed core 121 of the wire 120 on the crimping portion 140 of the terminal fitting 130, as shown in FIG. 8. A recess (not shown) for accommodating the reinforcing rib 150 may be formed in the upper surface of the anvil 170.

A crimper 171 is above the terminal fitting 130 and is lowered to deform the crimping pieces 147 of the terminal fitting 130 in conformity with the inner surface shape of the crimper 171. Thus, the crimping pieces 147 are pressed down to squeeze and surround the core 121. The bottom plate 148 is located below the core 121, and hence also is pressed down with the core 121. However, the portion of the bottom plate 148 corresponding to the crimping pieces 147 is strengthened by the reinforcing rib 150, and therefore is not squashed or elongated. The crimping of the terminal-mounted wire 110 is completed when the crimper 171 is lowered to a specified position.

As described above, the reinforcing rib 150 of the second embodiment is formed by bending the portion of conductive metal bottom plate 148 corresponding to the crimping pieces 147 and extends in the longitudinal direction of the wire 120. The reinforcing rib 150 strengthens the bottom plate portion 148. Hence, the bottom plate 148 is difficult to squash and is not likely to warp or elongate.

A thicker plate material has been considered to suppress the elongation of the bottom plate 148. However, a thicker plate material contradicts the miniaturization and weight saving of the terminal fitting. A separate member also could be placed on the bottom plate 148 to locally increase the thickness of the bottom plate 148 for suppressing elongation. However, the additional steps of positioning the separate member on the bottom plate 148 are not preferable. However, the reinforcing rib 150 of the second embodiment can be produced by a simple operation while achieving miniaturization and weight saving.

Further, the reinforcing rib 150 is formed by folding the plate material having the specified thickness. Thus, the reinforcing rib 150 can have double the thickness of the plate because of two plate parts put together and the strength thereof can be increased. Therefore, the elongation of the bottom plate 148 and the entire terminal fitting can be suppressed.

A third embodiment of the invention is described with reference to FIGS. 9 to 14. Elements with the same or similar construction as the second embodiment are identified by the same reference numerals, but are not described.

Figure 10:
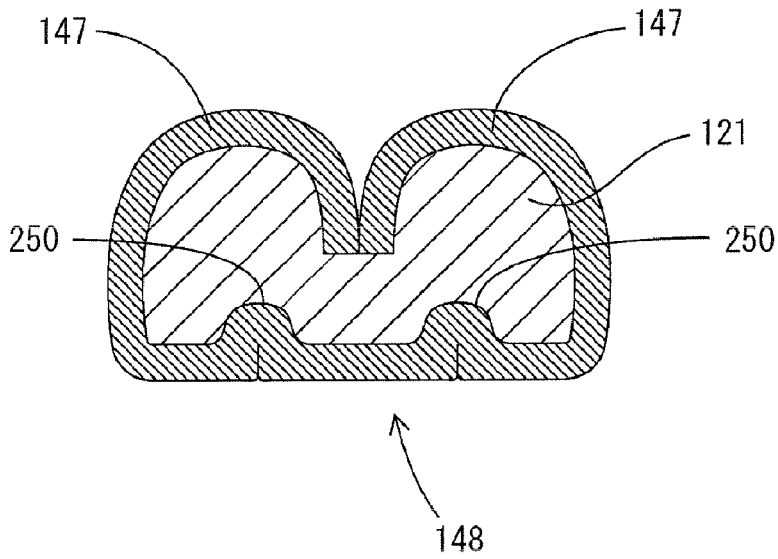
FIG. 10 is a section along B-B of FIG. 9.

The reinforcing rib 150 of the second embodiment projects down and out from the bottom plate 148. However, a reinforcing rib 250 in a terminal-mounted wire 210 of the third embodiment projects up and in from the bottom plate 148 toward the core 121. Further, one reinforcing rib 150 is shown in the second embodiment. However, at least two reinforcing ribs 250 are formed substantially side by side in the third embodiment. Specifically, as shown in FIG. 10, a bottom plate 148 is formed with substantially U-shaped folds formed by folding a conductive metal plate having a specified thickness to define two reinforcing ribs 250 extending in a longitudinal direction of a wire 120 (forward and backward directions FBD).

The reinforcing ribs 250 are formed at positions substantially corresponding to the respective crimping pieces 147 in a width direction, i.e. at a central part of the left half of the bottom plate 148 and a central part of the right half of the bottom plate 148. The reinforcing ribs 250 are formed substantially from the front ends to the rear ends of the crimping pieces 147 of the bottom plate 148 in the longitudinal direction of the wire 120 (see FIG. 9).

Figure 11:
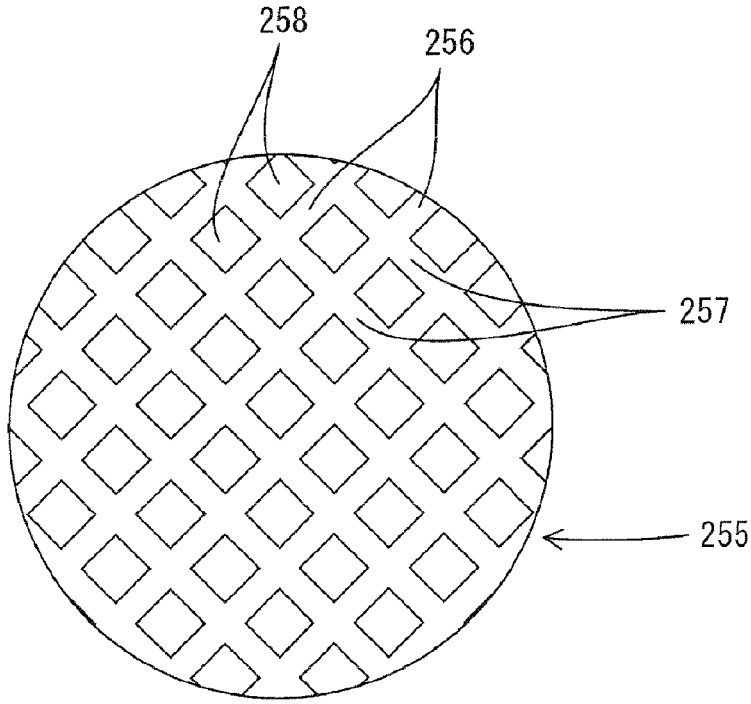
FIG. 11 is an enlarged view of an embossed portion formed in the outer surface of a reinforcing rib.

Embossments 255 are formed in the outer surfaces of the reinforcing ribs 250, for example, by press working. As shown in FIG. 11, each embossment 255 has many grooves 256 arranged substantially in parallel and many grooves 257 similarly arranged substantially in parallel to intersect at substantially right angles to form rectangular convex sections 258.

The reinforcing ribs 250 can be formed by punching, stamping, bending folding and/or embossing a terminal fitting plate having a specified thickness.

Figure 12:
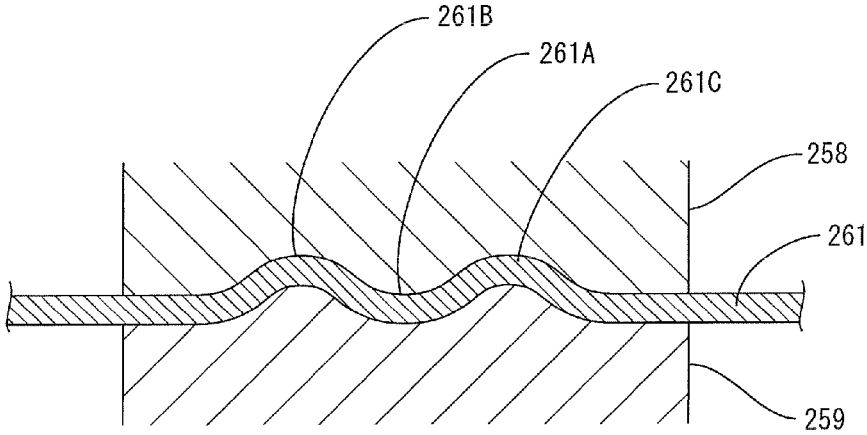
FIG. 12 is a diagram showing a first bending process.

A first bending process then is applied to the terminal fitting plate. More particularly, the terminal fitting plate is pressed from above and blow by molds 258, 259 in a press machine so that a widthwise central part of the terminal fitting plate becomes an upwardly concavity 261A and the opposite widthwise sides become upwardly convexities 261B, 261C so that the terminal fitting plate becomes wavy, as shown in FIG. 12.

Figure 13:
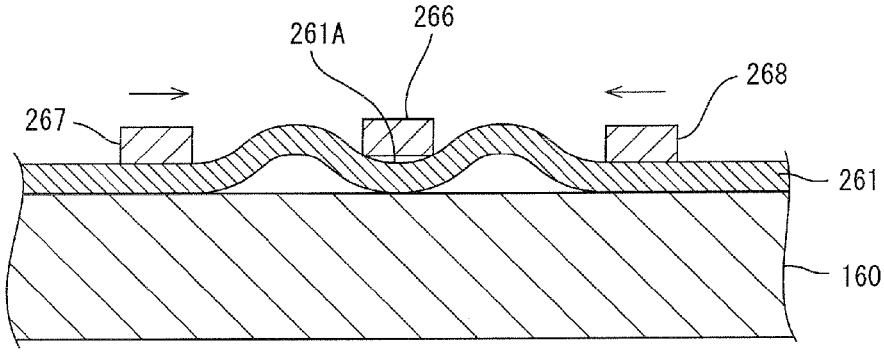
FIG. 13 is a diagram showing a second bending process.

A second bending process then is applied. More particularly, a terminal plate 261 formed by the first bending process is placed on a supporting table 160, as shown in FIG. 13. A support 266 is arranged above the concavity 261A in the central part of the terminal plate 261 after the first bending process and supports 267, 268 are arranged above the opposite widthwise ends of the terminal plate 261 left to be substantially flat. The supports 266 to 268 are rectangular parallelepipeds with lengths in the longitudinal direction of the wire that are substantially equal to those of the reinforcing ribs 250.

Figure 14:
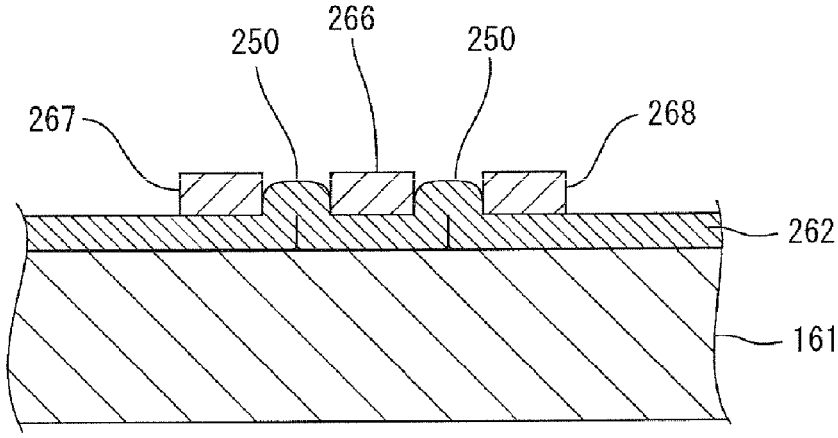
FIG. 14 is a diagram showing a folded state reached from a state of FIG. 13.

The support 266 in the center is pressed down toward the supporting table 160 and the supports 267, 268 at the opposite sides are moved toward the center to squeeze the convexities and to form the reinforcing ribs 250, as shown in FIG. 14. In this way, the central part of the left half of the bottom plate 148 and the central part of the right half of the bottom plate 148 are raised up at the upper side of the terminal plate 262. On the other hand, parts depressed by the first bending process are squeezed closed by the second bending process on the lower side of the terminal plate 262. Thus, the lower surface of the bottom plate 148 becomes substantially flat.

The reinforcing ribs 250 project toward the core 121 in the third embodiment. Thus, the area of the surface of the bottom plate 148 held in contact with the core 121 is increased and an electrically connected state of the core and the terminal fitting is improved in addition to the effects of the second embodiment.

Further, the embossments 255 are formed in the outer surfaces of the reinforcing ribs 250 by press working. A strong pressure acts on the outer surfaces of the projecting reinforcing ribs 250 during a crimping operation, and the embossments 255 in the outer surfaces of the reinforcing ribs 250 abrade the core 121 with a strong pressure. Thus, an oxide film formed around the core 121 can be broken reliably.

Figure 15:
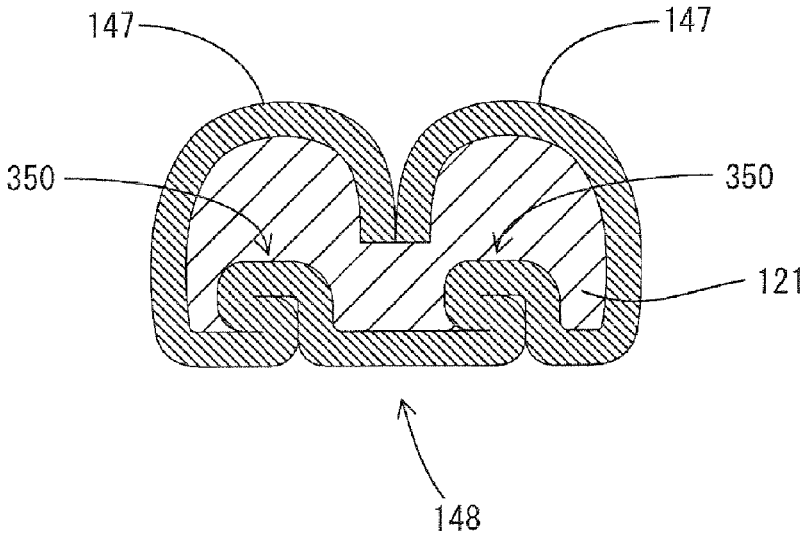
FIG. 15 is a section of a terminal fitting according to a fourth embodiment.

Reinforcing ribs 350 of a fourth embodiment are formed by laterally bending the reinforcing ribs 250 of the third embodiment, as shown in FIG. 15. Specifically, the reinforcing ribs 350 are formed by bending the leading ends of U-shaped folded parts that stand perpendicularly up from a bottom plate 148 in a width direction (left in FIG. 15) to change the projecting direction.

The reinforcing ribs 350 are formed by applying lateral forces (left in FIG. 15) to parts of the vertically standing reinforcing ribs above their middle portions with respect to a height direction to bend the reinforcing ribs as a third bending process after the second bending process of the third embodiment.

The core 121 is pressed against the upper ends of the vertically standing reinforcing ribs with a strong force during a crimping operation and may open a reinforcing rib that merely has been folded open. On the other hand, the extending direction of the reinforcing rib of the fourth embodiment is changed after the reinforcing ribs are formed to stand up substantially vertically from the bottom plate 148. Therefore, the folded parts are not likely to open.

Figure 16:
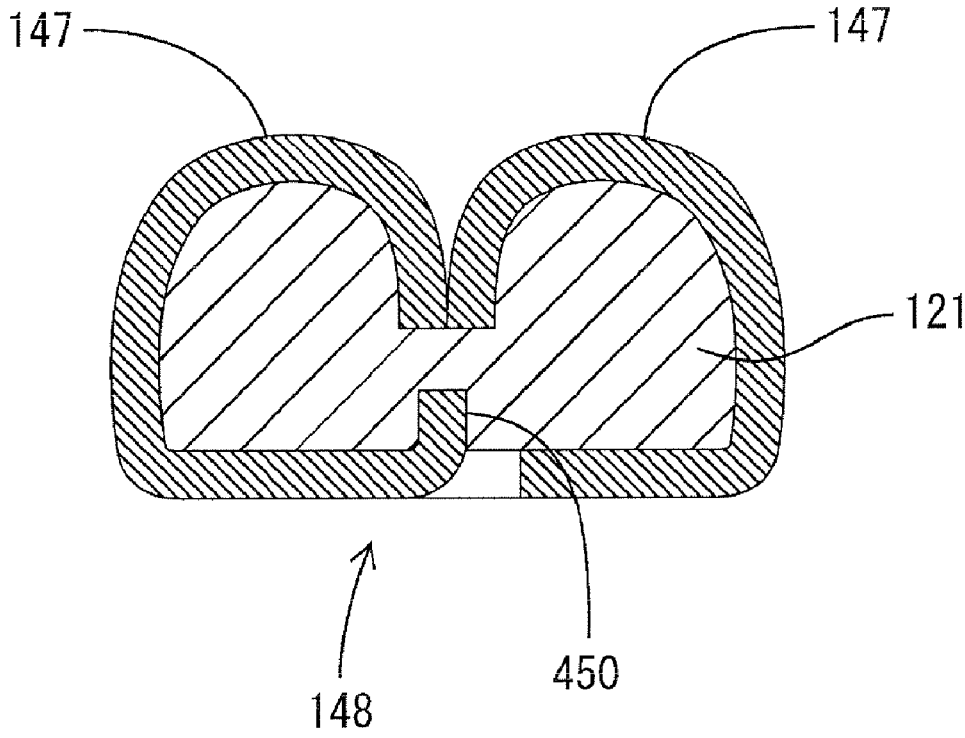
FIG. 16 is a section of a terminal fitting according to another embodiment.

The reinforcing ribs 150, 250 and 350 of the second through fourth embodiments are formed by folding the plate material. Three sides of a rectangular shape corresponding to a reinforcing rib 450 shown in FIG. 16 may be cut with the remaining one side left in the punching process and a part to become the reinforcing rib 450 may be bent to stand up from a cut side. However, a cutting operation and an operation of causing the reinforcing rib to stand up can be omitted and operability can be improved if the reinforcing rib 150 is formed by folding the plate material as in the above embodiments.

Although the reinforcing ribs 150, 250, 350 and 450 are formed by the pressing process and the bending process, it is also possible to form reinforcing ribs using another processing method or another type of bending process without limiting to this processing method.

Figure 18:
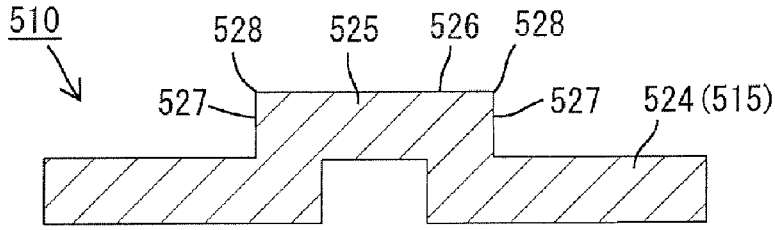
FIG. 18 is a section along Y-Y of FIG. 17.
Figure 19:
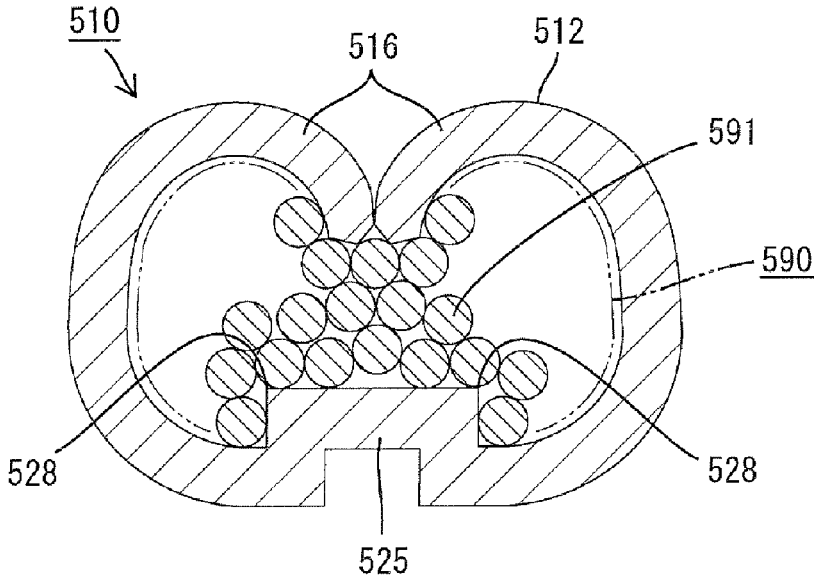
FIG. 19 is a section of a wire barrel portion crimped into connection with a core of a wire.

A fifth embodiment of the invention is described with reference to FIGS. 17 to 19. A terminal fitting 510 of this embodiment is illustrated as an LA terminal integrally formed by applying a bending process and the like to an electrically conductive metal plate material made of copper or copper alloy and connected with an end of a wire 590 arranged as one of various power supply lines directly connected with an unillustrated battery or the like.

The wire 590 is comprised of a core 591 formed by twisting strands made of aluminum or aluminum alloy with a high aluminum content. An insulation coating (not shown) surrounds the core 591 and may take the form of the insulation coating 598 shown in FIG. 21. As shown in FIG. 19, the insulation coating is stripped off to expose the core 591 at an end of the wire 590.

Figure 17:
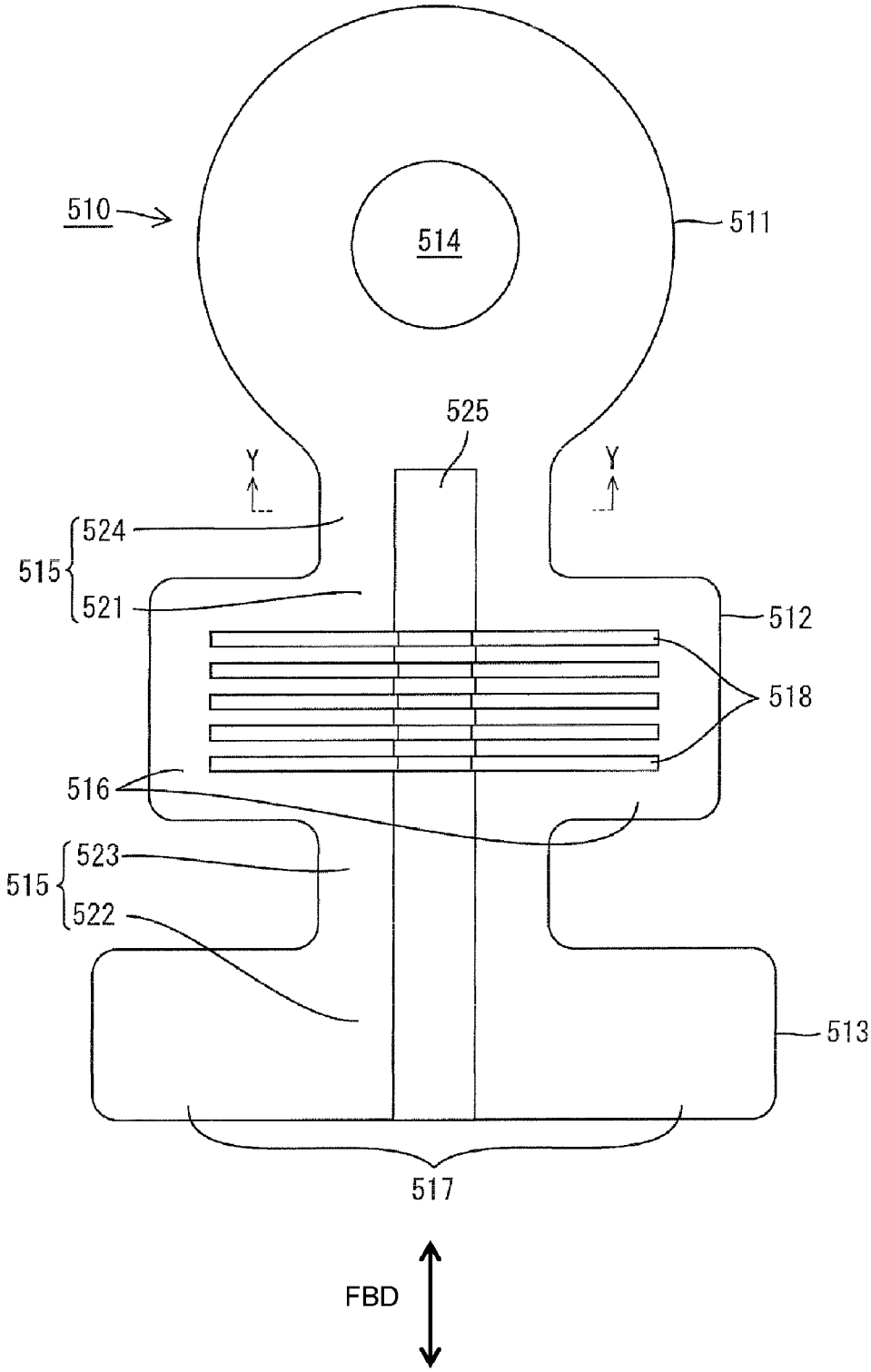
FIG. 17 is a development of a terminal fitting of a fifth embodiment.

As shown in FIG. 17, the terminal fitting 510 has a substantially ring-shaped connecting portion 511 at the front end, a wire barrel 512 behind the connecting portion 511 and an insulation barrel 513 behind the wire barrel 512. The wire barrel 512 and the insulation barrel 513 define a crimping portion.

The connecting portion 511 is formed with a through hole 514 for receiving an unillustrated mating connecting portion, such as a stud bolt. A substantially strip-shaped bottom plate 515 extends substantially straight in forward and backward directions FBD from the rear end of the connecting portion 511 to the rear end of the insulation barrel 513. The bottom plate 515 is shared by both the wire barrel 512 and the insulation barrel 513 and functions to support the wire 590 in forward and backward directions FBD.

The wire barrel 512 has two crimping pieces 516 that project from opposite sides of the bottom plate 515 with respect to a width direction that is substantially orthogonal to forward and backward directions FBD. Similarly, the insulation barrel 513 has two crimping pieces 517 that project from the opposite widthwise sides of the bottom plate 515. The crimping pieces 516, 517 are substantially rectangular plates. Dimensions of the crimping pieces 516 in forward and backward directions FBD exceed the corresponding dimensions of the crimping pieces 517. Additionally, the projecting lengths of the crimping pieces 517 exceed the projecting lengths of the crimping pieces 516. The crimping pieces 516 are crimped around the core 591 exposed at the end of the wire 590, and the crimping pieces 517 are crimped around the insulation coating of the wire 590 at positions behind the crimping pieces 516. Further, recessed grooves 518 extend in the width direction over the crimping pieces 516 and the bottom plate 515 in the inner surface of the wire barrel 512. The core 591 is bent and deformed to enter the recessed grooves 518 to restrict displacements of the core 591 in forward and backward directions FBD.

The bottom plate 515 is comprised of a first bottom plate portion 521 at the bottom of the wire barrel 512, a second bottom plate portion 522 at the bottom of the insulation barrel 513. A trunk 523 is located between the front end of the second bottom plate portion 522 and the rear end of the first bottom plate portion 521 and a neck 524 is located between the front end of the first bottom plate portion 521 and the rear end of the connecting portion 511. The neck 524, the first bottom plate portion 521, the trunk 523 and the second bottom plate portion 522 are connected unitarily in this order from the front. The neck 524 and the trunk 523 are narrowest parts of the terminal fitting 510.

A substantially widthwise central part of the bottom plate 515 is hammered or embossed over substantially the entire length in forward and backward directions FBD from the front end of the neck 524 to the rear end of the insulation barrel 513 to form a reinforcing rib 525 that extends substantially straight in forward and backward directions FBD. The reinforcing rib 525 is formed in the bottom plate 515 to define angular U-shaped projection that projects inwardly toward the wire 590, as shown in FIGS. 17 and 18. Additionally, the reinforcing rib 525 has a substantially strip-shaped plan view longitudinally crossing the bottom plate 515. A projecting end surface of the reinforcing rib 525 defines a substantially horizontal supporting surface 526 for supporting the wire 590. Substantially vertical side surfaces 527 extend from opposite sides of the supporting surface 526 and angular edges 528 unitarily connect the supporting surface 526 and the side surfaces 527.

The terminal fitting 510 is set in a mold (not shown). Additionally, the core 591 exposed at the end of the wire 590 is placed on the supporting surface 526 of the bottom plate 515 of the wire barrel 512 and the insulation coating of the wire 590 is placed on the supporting surface 526 of the bottom plate 515 of the insulation barrel 513 behind the exposed core 591. An unillustrated movable mold is moved toward an unillustrated fixed mold in this state to crimp, bend or fold the crimping pieces 516 into connection with the core 591 and to crimp, bend or fold the crimping pieces 517 into connection with the insulation coating. The edges 528 of the first bottom plate portion 521 of the wire barrel 512 are pressed into contact with the outer surface of the core 591 to exhibit an edge action, as shown in FIG. 19, for breaking an aluminum oxide film on the other surface of the core 591.

A large compression force is exerted on the first bottom plate 521 in a thickness direction as the wire barrel 512 is crimped. This force can warp the bottom plate 515 in a direction to displace the neck 524, the trunk 523 and the second bottom plate portion 525 in a height direction and can elongate the first bottom plate portion 521. The deformed terminal fitting 510 may not be able to face opposite to the mating connecting portion. However, the reinforcing rib 525 resists warping of the bottom plate 515 so that the terminal fitting 510 is not bent up. Further, the bottom plate 515 will not elongate and the neck 524, which is narrower than other parts in the terminal fitting 510, is more rigid.

Further, the reinforcing rib 525 projects toward the side where the wire 590 is to arranged, and does not enlarge the terminal fitting 510.

Figure 20:
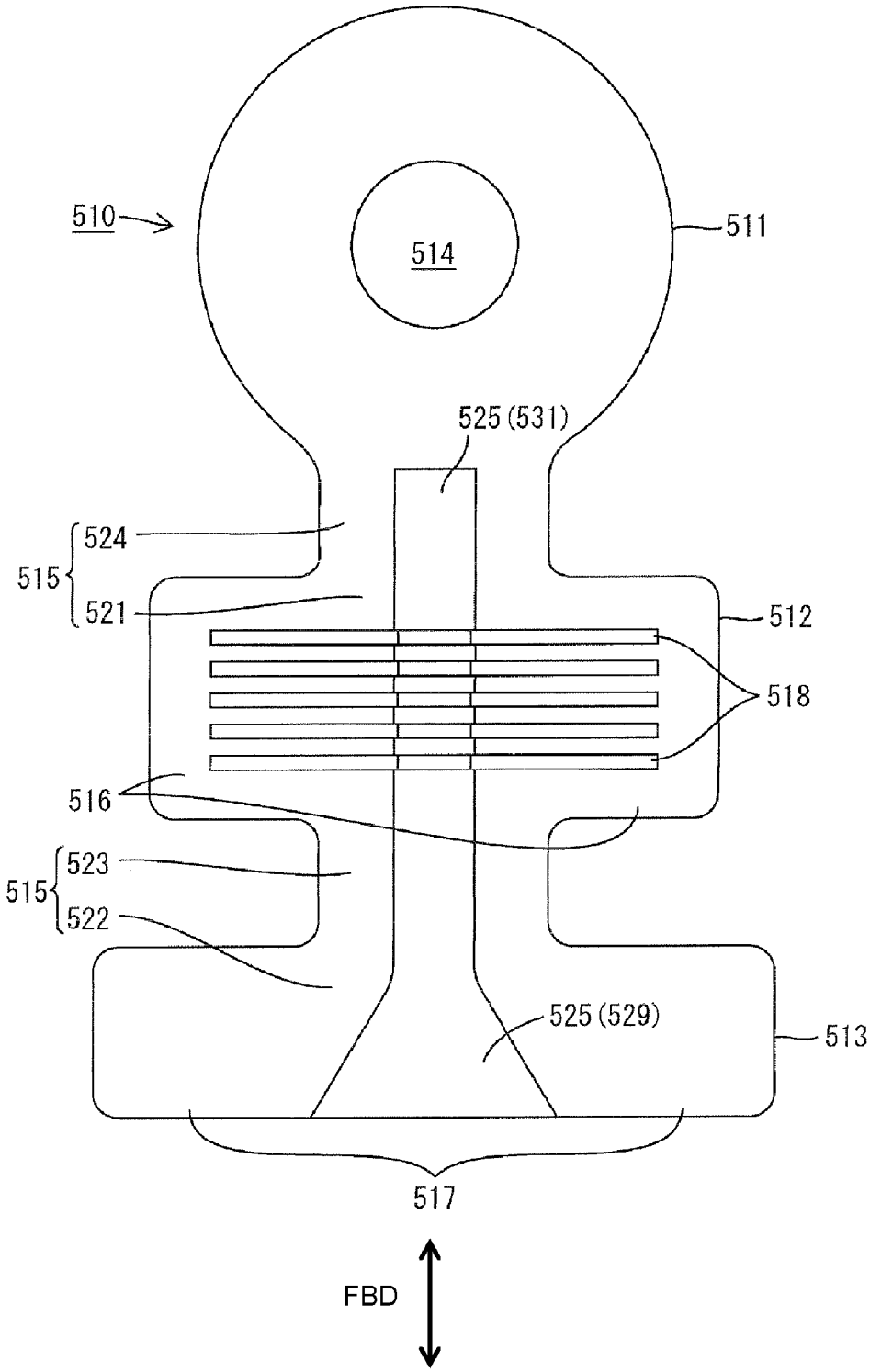
FIG. 20 is a development of a terminal fitting of a sixth embodiment.
Figure 21:
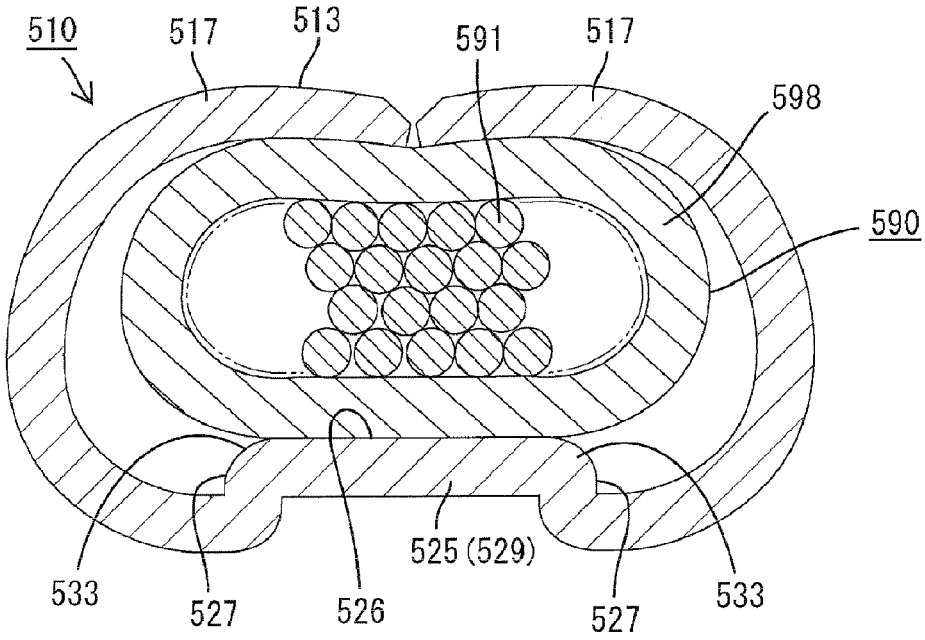
FIG. 21 is a section of an insulation barrel portion crimped into connection with an insulation coating of a wire.

A terminal fitting 510 according to a sixth embodiment is described with reference to FIGS. 20 and 21. In the sixth embodiment, the shape of a reinforcing rib 525 differs from that in the fifth embodiment. Other structural parts are the same as or similar to the fifth embodiment. Those parts that are the same as or similar to the fifth embodiment are identified by the same reference numerals and not described again.

The reinforcing rib 525 includes front and rear reinforcing ribs 531 and 529 respectively. The front reinforcing rib 525 extends in forward and backward directions FBD along a neck 524, a first bottom plate portion 521 and a trunk 523 and has a constant narrow width similar to the fifth embodiment. On the other hand, the rear reinforcing rib 529 extends along a second bottom plate portion 522 and increases gradually in width from the rear end of the front reinforcing rib 531 to the rear end of the entire terminal fitting 510. In other words, a supporting surface 526 of the rear reinforcing rib 529 is wider than that 526 of the front reinforcing rib 531.

Angular edges 528 are provided at the corners of the projecting end of the front reinforcing rib 531 and extend along positions corresponding at least to the wire barrel 512 and preferably along substantially the entire length of the front reinforcing rib 531. The angular edges 528 connect the supporting surface 526 and both side surfaces 527. On the other hand, rounded R-portions 533 connect the supporting surface 526 and the side surfaces 527 at the corners of the projecting end of the rear reinforcing rib 529 and are provided at positions corresponding to the insulation barrel 513, as shown in FIG. 21.

The supporting surface 526 of the rear reinforcing rib 529 is widened according to the sixth embodiment. Thus, the wire 590 is supported reliably thereon without wobbling. Further, the edges 528 are provided at the corners of the projecting end of the front reinforcing rib 531. The edges 528 remove any insulating oxide coating formed on a core 591 of a wire 590 similar to the fifth embodiment. On the other hand, since the rounded R-portions 533 are provided at the corners of the projecting end of the rear reinforcing rib 529, the wire 590 is supported stably without damaging an insulation coating 598.

The terminal fitting may be a female terminal fitting with a box-shaped connecting portion for receiving a male tab. Further, the terminal fitting may be a male terminal fitting with a connecting portion including a male tab. Furthermore, the terminal fitting may include a wire barrel in the form of a tubular closed barrel.

The wire may be a copper wire with a core formed by copper strands made of copper or copper alloy.

Further, the reinforcing rib may be formed in a range from an intermediate position of the neck portion in forward and backward directions to an intermediate position of the insulation barrel portion in forward and backward directions. Furthermore, the reinforcing rib may project outward toward a side opposite to the side where the wire is arranged.

What is claimed is:

1. A terminal fitting, comprising:

a connecting portion configured for connection with a mating terminal fitting;

a crimping portion substantially continuous with a rear end of the connecting portion and including a base plate extending rearward from the base wall of the connecting portion and configured so that parts of the base plate extend collinearly rearward from the connecting portion, crimping pieces projecting from the base plate and configured for crimped connection with a wire so that an end portion of the wire is at least partly surrounded by the base plate and the crimping pieces, the crimping portion including a wire barrel for crimped connection with a core of the wire and at least one insulation barrel behind the wire barrel for crimped connection with insulation coating of the wire; and at least two parallel reinforcing ribs projecting up from the base plate and extending in substantially forward and backward directions along substantially all of the wire barrel, the reinforcing rib defining a substantially constant projecting height from the base plate along substantially all of the wire barrel.

2. The terminal fitting of claim 1, wherein the reinforcing rib projects toward a wire side.

3. The terminal fitting of claim 1, wherein the crimping portion includes a wire barrel to be crimped into connection with a core exposed by removing an insulation coating at an end portion of the wire, and the reinforcing rib being formed at least over an entire region of the wire barrel in the forward and backward directions.

4. The terminal fitting of claim 1, wherein a leading end of the reinforcing ribs are bent laterally and substantially faces in a width direction.

5. The terminal fitting of claim 1, wherein at least one embossment is formed in outer surfaces of the reinforcing ribs.

6. The terminal fitting of claim 1, wherein the reinforcing ribs are formed by applying a bending process to a plate material.

7. The terminal fitting of claim 6, wherein the reinforcing ribs are formed by folding the plate material.

8. The terminal fitting of claim 1, wherein:

the crimping portion includes a wire barrel for crimped connection with a core exposed by removing an insulation coating of an end portion of the wire and at least one insulation barrel behind the wire barrel for crimped connection with the insulation coating of the wire;

the base plate extends in forward and backward directions FBD to connect the connecting portion, the wire barrel and the insulation barrel and a part between the wire barrel and the connecting portion defines as a neck, and the reinforcing ribs extend continuously in forward and backward directions from the neck to the insulation barrel.

9. The terminal fitting of claim 8, wherein the reinforcing ribs are wider in the insulation barrel than in the wire barrel.

10. The terminal fitting of claim 8, wherein:

angular edges are formed at corners of a projecting end of the reinforcing ribs corresponding to the wire barrel, and rounded R-portions being formed at positions of the corners of the projecting end of the reinforcing ribs corresponding to the insulation barrel.

11. A terminal fitting for crimped connection with a wire having a core formed from a plurality of conductive strands and insulation covering the core, the terminal fitting comprising:

a connecting portion configured for connection with a mating terminal fitting;

a base plate extending rearward from the connecting portion along forward and backward directions and configured so that parts of the base plate extend collinearly rearward from the connecting portion;

crimping pieces projecting from opposite sides of the base plate and configured for crimped deformation toward one another and around the wire; and parallel reinforcing ribs projecting up from the base plate sufficiently for penetrating between the strands of the core, the reinforcing ribs extending substantially in the forward and backward directions along at least a portion of the base plate that has the crimping pieces, the reinforcing ribs having a constant projecting height between the crimping pieces.

12. The terminal fitting of claim 11, wherein at least one embossment is formed in an outer surface of the reinforcing ribs.

13. The terminal fitting of claim 11, wherein the reinforcing ribs projects toward a space between the crimping pieces.

14. The terminal fitting of claim 13, wherein leading ends of the reinforcing ribs are bent laterally and substantially face in a width direction.

* * * * *